US011495919B2

(12) United States Patent
Oosaka

(10) Patent No.: US 11,495,919 B2
(45) Date of Patent: Nov. 8, 2022

(54) CONNECTOR ASSEMBLY IN WHICH GROUND TERMINALS ARE COUPLED TO FORM A SHIELDING

(71) Applicant: JAPAN AVIATION ELECTRONICS INDUSTRY, LIMITED, Tokyo (JP)

(72) Inventor: Junji Oosaka, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 17/245,553

(22) Filed: Apr. 30, 2021

(65) Prior Publication Data

US 2021/0359474 A1 Nov. 18, 2021

(30) Foreign Application Priority Data

May 13, 2020 (JP) ..... JP2020-084468
May 26, 2020 (JP) ..... JP2020-091146
(Continued)

(51) Int. Cl.
*H01R 13/6586* (2011.01)
*H01R 12/71* (2011.01)
*H01R 13/6471* (2011.01)

(52) U.S. Cl.
CPC ..... *H01R 13/6586* (2013.01); *H01R 12/716* (2013.01); *H01R 13/6471* (2013.01)

(58) Field of Classification Search
CPC ..... H01R 13/6586; H01R 13/6594; H01R 13/6596; H01R 13/6597; H01R 13/6471;
(Continued)

(56) References Cited

U.S. PATENT DOCUMENTS 8,083,527 B2 * 12/2011 Takeuchi ..... H01R 12/52 439/74
2008/0214051 A1 * 9/2008 Obikane ..... H01R 12/52 439/607.41

(Continued)

FOREIGN PATENT DOCUMENTS

JP 2019-121439 7/2019
TW 202010200 A 3/2020

OTHER PUBLICATIONS

Office Action dated Feb. 10, 2022 issued in Taiwanese patent application No. 110116342 along with an English translation.
U.S. Appl. No. 17/245,487, filed Apr. 30, 2021.

*Primary Examiner* — Marcus E Harcum
(74) *Attorney, Agent, or Firm* — Greenblum & Bernstein, P.L.C.

(57) ABSTRACT

In a connector assembly in which a connector that includes a first terminal, a second terminal, a ground terminal including a shielding portion (plate portion) positioned between the first terminal and the second terminal, and a shell having conductivity and a frame-like shape and a mating connector that includes a first mating terminal and a second mating terminal that are connected with the first terminal and the second terminal respectively, a mating ground terminal including a mating shielding portion (mating plate portion) positioned between the first mating terminal and the second mating terminal, and a mating shell having conductivity and a frame-like shape are fitted to each other, the ground terminal and the shell are integrally formed through bending processing for metal plate. The ground terminal and the mating ground terminal are connected with each other through elastic contact between the shielding portion and the mating shielding portion.

1 Claim, 15 Drawing Sheets

(30) Foreign Application Priority Data

| | | |
|---|---|---|
| Jun. 12, 2020 | (JP) | JP2020-102280 |
| Jun. 18, 2020 | (JP) | JP2020-105098 |
| Jul. 14, 2020 | (JP) | JP2020-120397 |
| Jul. 16, 2020 | (JP) | JP2020-121984 |
| Aug. 5, 2020 | (JP) | JP2020-132981 |
| Aug. 25, 2020 | (JP) | JP2020-141324 |
| Sep. 16, 2020 | (JP) | JP2020-155230 |

(58) Field of Classification Search
CPC ... H01R 12/712; H01R 12/714; H01R 12/716
USPC ..... 439/66, 74, 65, 101, 108, 92
See application file for complete search history.

(56) References Cited

U.S. PATENT DOCUMENTS

| | | | | |
|---|---|---|---|---|
| 2013/0012039 | A1* | 1/2013 | Nose | H01R 12/716 439/74 |
| 2014/0308825 | A1* | 10/2014 | Hashiguchi | H01R 13/24 439/66 |
| 2015/0207248 | A1* | 7/2015 | Takenaga | H01R 13/6582 439/74 |
| 2017/0033510 | A1* | 2/2017 | Ozeki | H01R 43/205 |
| 2018/0198241 | A1* | 7/2018 | Ooi | H01R 12/73 |
| 2019/0190209 | A1* | 6/2019 | Horino | H01R 13/6582 |
| 2020/0212634 | A1* | 7/2020 | Ter | H01R 12/73 |
| 2020/0212635 | A1* | 7/2020 | Chen | H01R 13/6471 |
| 2020/0220307 | A1* | 7/2020 | Sunaga | H01R 13/6582 |
| 2020/0244011 | A1* | 7/2020 | Kitazawa | H01R 13/6585 |
| 2020/0358213 | A1* | 11/2020 | Tanaka | H01R 12/73 |
| 2021/0005993 | A1* | 1/2021 | Yanase | H01R 43/24 |
| 2021/0119386 | A1* | 4/2021 | Lee | H01R 13/113 |
| 2021/0143567 | A1* | 5/2021 | Someya | H01R 13/5219 |
| 2021/0143586 | A1* | 5/2021 | Ishida | H01R 12/73 |
| 2021/0175649 | A1 | 6/2021 | Amemori et al. | |
| 2021/0175665 | A1* | 6/2021 | Someya | H01R 13/629 |
| 2021/0359443 | A1* | 11/2021 | Mamuro | H01R 12/73 |
| 2021/0391661 | A1* | 12/2021 | Maeda | H01R 13/6471 |
| 2022/0094088 | A1* | 3/2022 | Ter | H01R 12/716 |
| 2022/0123508 | A1* | 4/2022 | Yamauchi | H01R 13/6585 |

* cited by examiner

CONNECTOR ASSEMBLY IN WHICH GROUND TERMINALS ARE COUPLED TO FORM A SHIELDING

TECHNICAL FIELD

The present invention relates to a connector assembly in which a connector and a mating connector are opposed and fitted to each other.

BACKGROUND ART

FIGS. 1A and 1B illustrate a connector (referred to as a receptacle in Japanese Patent Application Laid Open No. 2019-121439 which will be referred to as Patent Literature 1 below) 10 described in Patent Literature 1 and FIG. 2 illustrates a mating connector (referred to as a plug in Patent Literature 1) 20 also described in Patent Literature 1 as conventional examples of a connector and a mating connector that are fitted to each other to constitute a connector assembly.

The connector 10 has a structure in which signal terminals 12, 13, and 14 and ground terminals 15 and 16 are attached to a connector housing 11 and a shell-like conductor 17 is further attached. The shell-like conductor 17 has a substantially rounded rectangular shape which continues on the circumferential side of the connector housing 11 in a circumferential direction and surrounds the upper surface circumference and lateral surface upper portion of the connector housing 11.

The signal terminals 12 to 14 are disposed so that the ground terminal 15 is interposed between the signal terminals 12 and 13 and the ground terminal 16 is interposed between the signal terminals 13 and 14. Thus, the signal terminals 12 to 14 are spaced apart from each other by the ground terminals 15 and 16. The ground terminals 15 and 16 are formed through punching processing for plate material and have a shape illustrated in FIG. 1B.

The connector housing 11 has a fitting portion insertion hole 11*a* on the center thereof and the signal terminals 12 to 14 and the ground terminals 15 and 16 are exposed on the fitting portion insertion hole 11*a*. The reference characters 12*a* to 16*a* in FIGS. 1A and 1B denote connection end portions, which are to be connected to a mounting board, of respective signal terminals 12 to 14 and ground terminals 15 and 16.

The mating connector 20 has a structure in which signal terminals 22, 23, and 24 are attached to a connector housing 21 and a shell-like conductor 25 is further attached. The signal terminals 22 to 24 are held by projection portions 26*a* to 26*c* which are aligned on the central portion of an insert-molded resin portion 26 of the connector housing 21. The shell-like conductor 25 has a shape following a circumferential wall portion 27 of the connector housing 21.

As described above, the connector 10 and mating connector 20 of the related art respectively include the shell-like conductor 17 and shell-like conductor 25 which serve as outer shields and the connector 10 further includes the ground terminals 15 and 16 which serve as inner shields and shield between the signal terminals 12 to 14. Thus, EMC countermeasures and crosstalk countermeasures among the signal terminals are taken in the connector 10 and mating connector 20 of the related art.

However, the shell-like conductor 17 serving as the outer shield and the ground terminals 15 and 16 serving as the inner shields are separate bodies (separate components) in the connector 10, and the ground terminal 15 and the ground terminal 16 are also separate bodies. Thus, the higher number of components and the higher number of assembly steps have been required.

BRIEF SUMMARY OF THE INVENTION

The object of the present invention is to provide a connector assembly in which the number of components can be reduced compared to the related art in its structure in which a connector and a mating connector constituting the connector assembly include an outer shield and an inner shield.

In a connector assembly in which one connector and another connector are fitted to each other, one connector includes a one-piece metal component. A part of the metal component is all or a part of a shell, and all or a part of the rest of the metal component is all or a part of a ground terminal. The shell serves as an outer shield. The ground terminal includes a shielding portion serving as an inner shield.

Effects of the Invention

According to the present invention, in a connector assembly in which a connector and a mating connector are fitted to each other, a shell serving as an outer shield and a ground terminal including a shielding portion serving as an inner shield are integrally formed in the connector through bending processing for metal plate. The shielding portion performs electromagnetic shielding between different kinds of terminals. Accordingly, the number of components and the number of assembly steps can be reduced and an inexpensive connector assembly can be obtained.

LIST OF REFERENCE NUMERALS

Figure 1A:
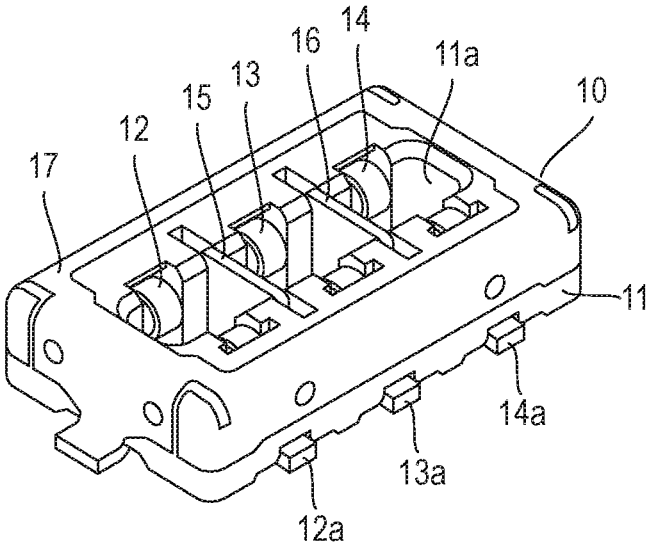
FIG. 1A (PRIOR ART)
FIG. 1A is a perspective view illustrating a connector constituting a connector assembly of a related art.
Figure 1B:
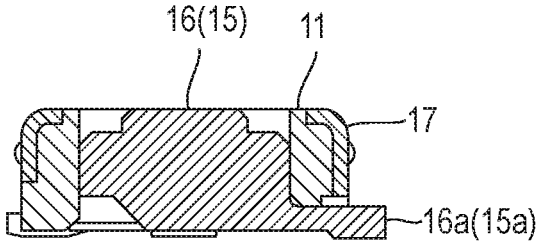
FIG. 1B (PRIOR ART)
FIG. 1B is a sectional view of the connector illustrated in FIG. 1A.
Figure 2:
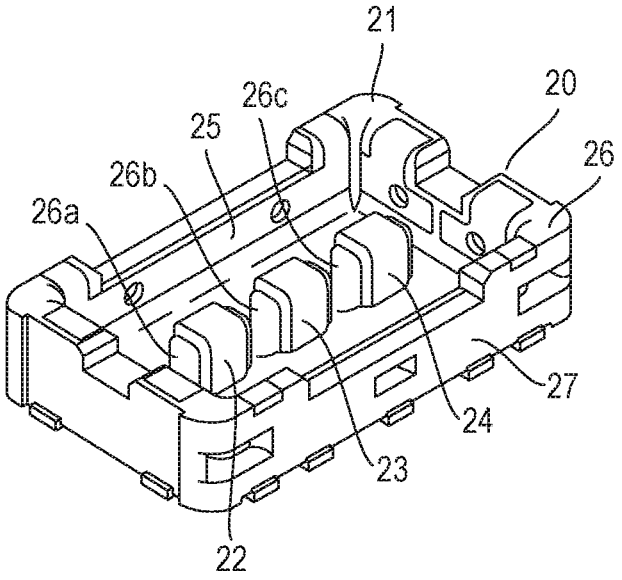
FIG. 2 (PRIOR ART)
FIG. 2 is a perspective view illustrating a mating connector constituting the connector assembly of the related art.
Figure 3A:
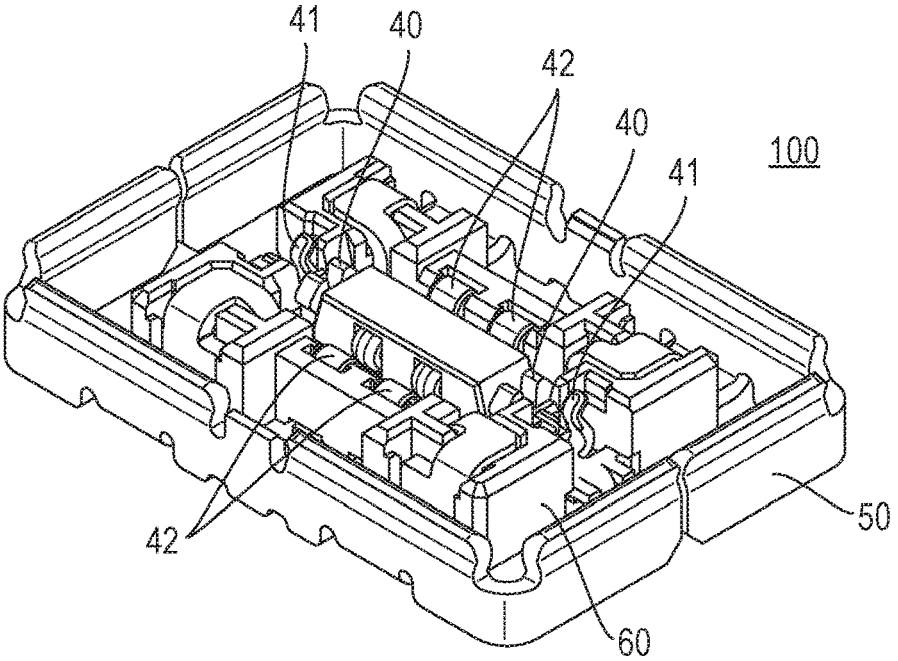
FIG. 3A is an upper perspective view illustrating one connector constituting a connector assembly according to a first embodiment of the present invention.
Figure 3B:
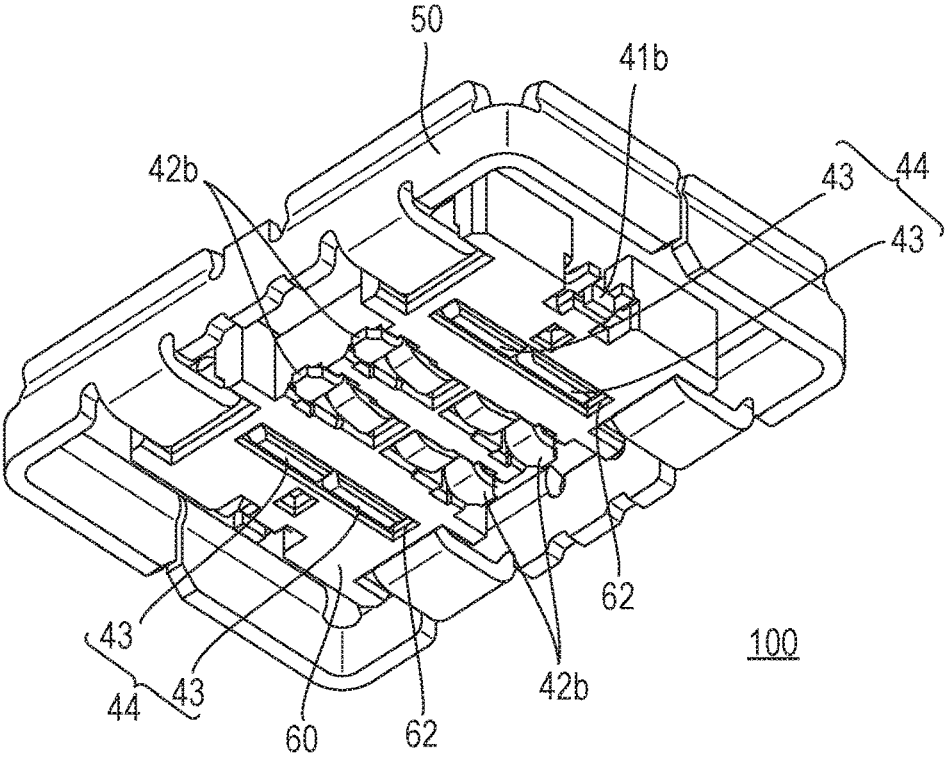
FIG. 3B is a lower perspective view illustrating the connector illustrated in FIG. 3A.
Figure 4A:
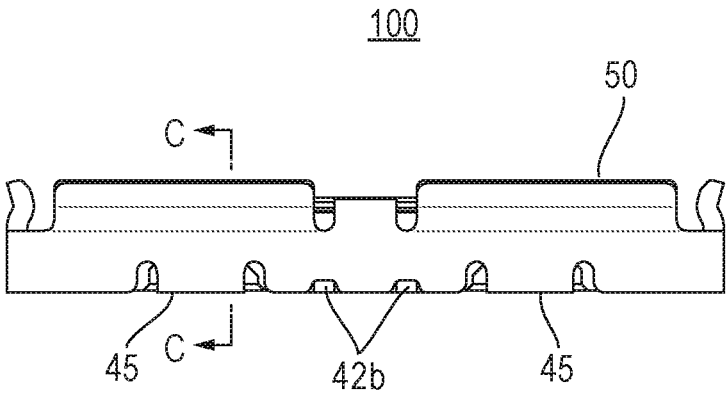
FIG. 4A is a front elevational view illustrating the connector illustrated in FIG. 3A.
Figure 4B:
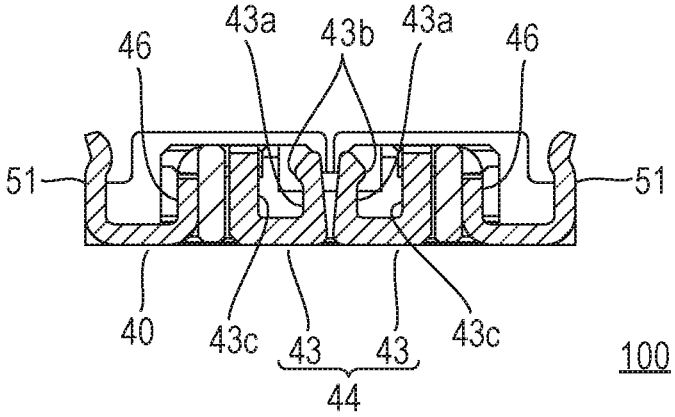
FIG. 4B is a sectional view taken along the C-C line in FIG. 4A.

10: connector
11: connector housing
11*a*: fitting portion insertion hole
12 to 14: signal terminal
12*a* to 14*a*: connection end portion
15, 16: ground terminal
15*a*, 16*a*: connection end portion
17: shell-like conductor
20: mating connector
21: connector housing
22 to 24: signal terminal
25: shell-like conductor
26: insert-molded resin portion
26*a* to 26*c*: projection portion
27: circumferential wall portion
40, 40': ground terminal
41: first terminal
41*a*: contact piece
41*b*: connection portion
42: second terminal
42*a*: contact piece
42*b*: connection portion
43: U-shaped portion
43*a*: leg portion
43*b*: protrusion portion
43*c*: leg portion
44: plate portion
45: coupling portion
46: held portion
46*a*: protrusion
47: extension portion
48: U-shaped portion
48*a*: plate surface
48*b*: leg portion
49: contact portion
50: shell
51, 52: outer wall portion
51*a*, 52*a*: curved portion
53: cutout
60: insulator
61: concave portion
62: slit
70, 70': mating ground terminal
71: first mating terminal
71*a*: connection portion
72: second mating terminal
72*a*: connection portion
73: mating plate portion
74: concave portion
75: projection portion
76: coupling portion
77: extension portion
78: flat plate portion
78*a*: plate surface
80: mating shell
81, 82: outer wall portion
81*a*, 82*a*: convex portion
81*b*: extension portion
82*b*: protrusion
83: coupling portion
84, 85: cutout
90: mating insulator
91: bottom plate portion
92: side wall
93: concave portion
100, 100': connector
200, 200': mating connector

DETAILED DESCRIPTION

Embodiments of the present invention will be described based on examples with reference to the accompanying drawings.

First Embodiment

Figure 5:
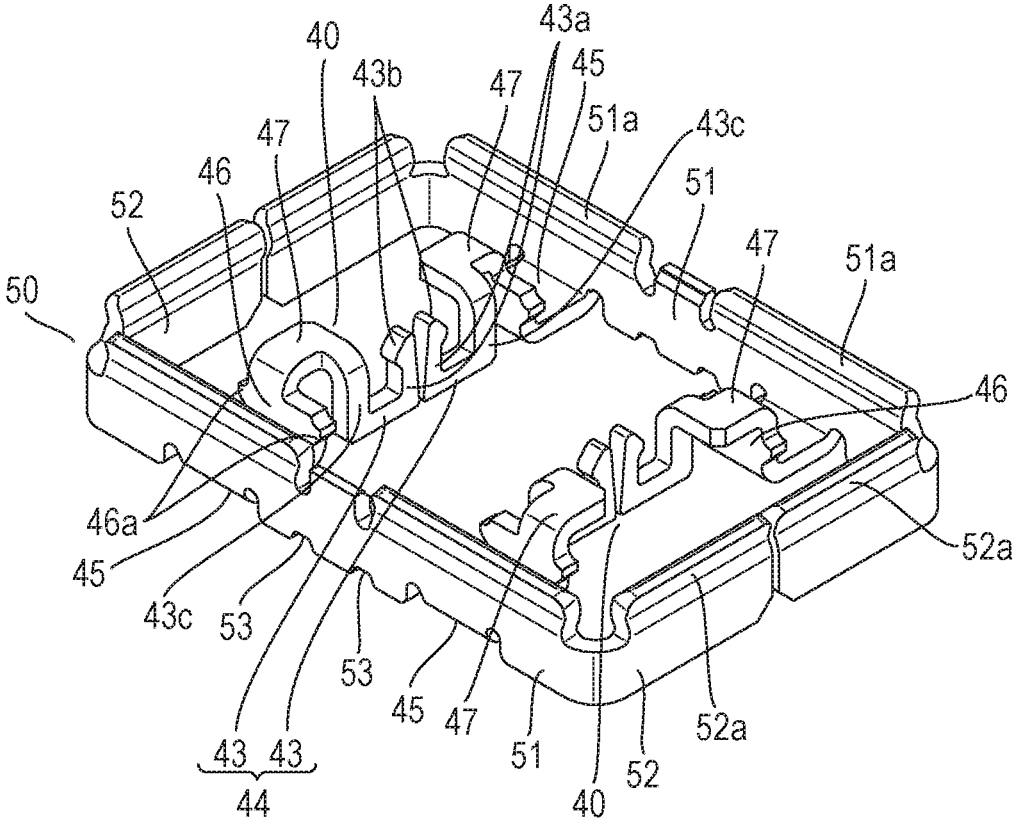
FIG. 5 is a perspective view illustrating ground terminals integrated with a shell illustrated in FIG. 3A.
Figure 6:
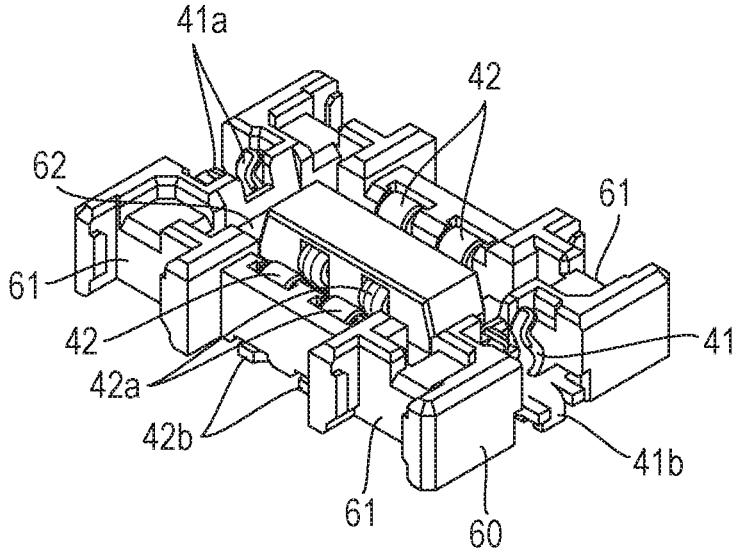
FIG. 6 is a perspective view illustrating an insulator and terminals held by the insulator illustrated in FIG. 3A.
Figure 7A:
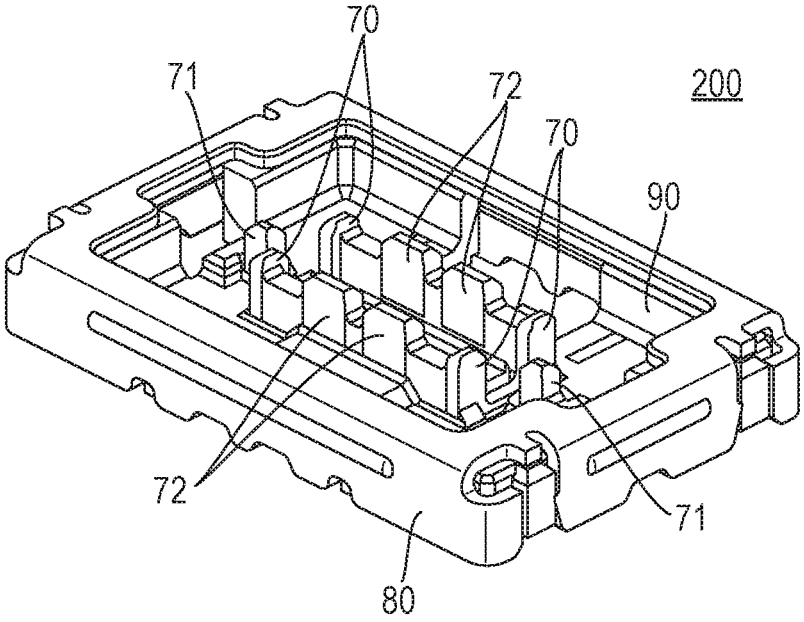
FIG. 7A is an upper perspective view illustrating a mating connector constituting the connector assembly according to the first embodiment of the present invention.
Figure 7B:
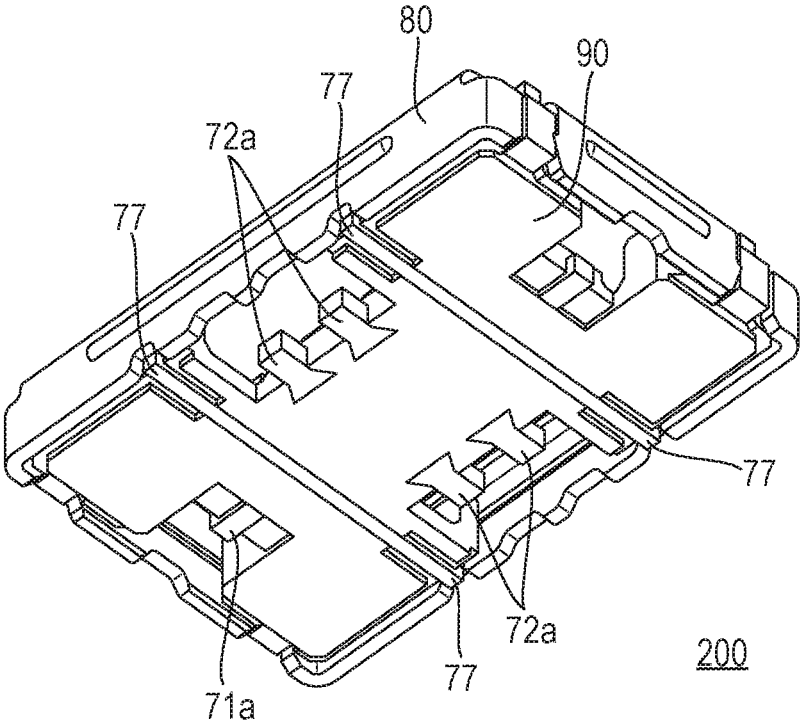
FIG. 7B is a lower perspective view illustrating the mating connector illustrated in FIG. 7A.

FIGS. 3A, 3B, 4A, and 4B illustrate one connector 100 constituting a connector assembly according to a first embodiment of the present invention. The connector 100 is composed of first terminals 41, second terminals 42, ground terminals 40, a shell 50, and an insulator 60. The ground terminals 40 are integrally formed with the shell 50 which is the outer shell of the connector 100 in this example. FIG. 5 illustrates details of the ground terminals 40 and the shell 50 that are mutually integrally formed, and FIG. 6 illustrates the insulator 60 and the first and second terminals 41 and 42 that are held by the insulator 60.

The insulator 60 is made of resin and has a substantially rectangular parallelepiped shape as a whole. The first terminals 41 are respectively attached to both longitudinal end portions of the insulator 60, and two second terminals 42 for each of two columns, that is, four second terminals 42 in total are attached to the central portion of the insulator 60.

The first terminal 41 includes a pair of contact pieces 41*a* which face each other, and the second terminal 42 also includes a pair of contact pieces 42*a* which face each other.

Connection portions 41*b* and 42*b*, which are to be connected with a board, of the first terminals 41 and second terminals 42 are positioned on the bottom surface side of the insulator 60. The two first terminals 41 are used for high frequency signals (high speed transmission) and the four second terminals 42 are used for low frequency signals (low speed transmission) in this example.

The shell 50 having conductivity is formed through bending processing for metal plate and a rectangular frame structure thereof is composed of two bodies having U-shaped outer walls. Curved portions 51*a* and curved portions 52*a* are formed respectively on upper ends of outer wall portions 51 positioned on two opposed long sides of the rectangle and on upper ends of outer wall portions 52 positioned on two opposed short sides of the rectangle. The curved portions 51*a* and 52*a* are curved to slightly protrude toward the inside of the frame.

Two pieces of ground terminals 40, which are integrated with the shell 50, are formed in the frame of the shell 50 and both ends of the ground terminal 40 are coupled and supported with the outer wall portions 51 which are opposed to each other. The ground terminals 40 are respectively provided on two spots in the longitudinal direction of the shell 50.

The ground terminal 40 includes a plate portion 44 composed of a pair of U-shaped portions 43 on the center thereof. The U-shaped portions 43 have U shapes opening upward and are positioned side by side on the same plane. On end sides of leg portions 43*a* of mutually-adjacent U shapes in the pair of U-shaped portions 43, protrusion portions 43*b* are formed in a manner to protrude mutually outward.

The ground terminal 40 is composed of the above-mentioned plate portion 44, coupling portions 45, held portions 46, and extension portions 47. The coupling portions 45 have shapes respectively bent and extended from lower ends of the outer wall portions 51, which are opposed to each other, toward the inside of the frame. The held portions 46 are bent and raised from the coupling portions 45 respectively. The extension portions 47 are extended from the upper ends of respective held portions 46 to the ends of leg portions 43*c* positioned on the mutual outer sides of the pair of U-shaped portions 43. In addition, a pair of protrusions 46*a* are formed on each held portion 46 in a manner to respectively protrude in the width direction.

Two small cutouts 53 are formed on part between two coupling portions 45 on the lower end of each outer wall portion 51. The cutouts 53 are formed to respectively correspond to the positions of the connection portions 42*b* of the second terminals 42. The connection portions 42*b* are exposed to the bottom surface side of the insulator 60 in a manner to be held by the insulator 60.

The shell 50 with which the ground terminals 40 are integrally formed as described above is attached to the insulator 60 holding the first terminals 41 and the second terminals 42. The attachment of the shell 50 is performed by putting the shell 50 over the insulator 60 and forcing the shell 50 into the insulator 60. At this time, the pairs of held portions 46 including the protrusions 46*a* in two ground terminals 40 are pressed into four concave portions 61 of the insulator 60 and are fixed and held. In addition, each of the plate portions 44, each composed of a pair of U-shaped portions 43, of two ground terminals 40 is inserted into a slit 62 of the insulator 60 and positioned between the first terminal 41 and the second terminals 42, thus serving as a shielding portion. Thus, the connector 100 illustrated in FIGS. 3A, 3B, 4A, and 4B is completed.

A mating connector 200 that is fitted to the above-described connector 100 to constitute the connector assembly will now be described.

Figure 9:
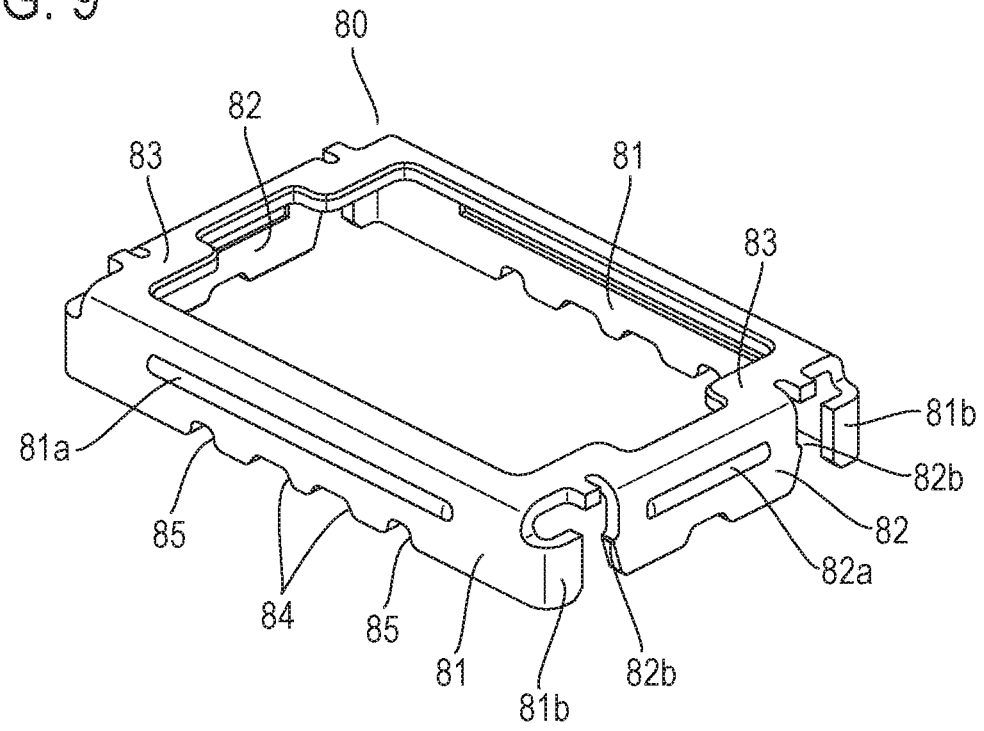
FIG. 9 is a perspective view illustrating a mating shell illustrated in FIG. 7A.
Figure 10:
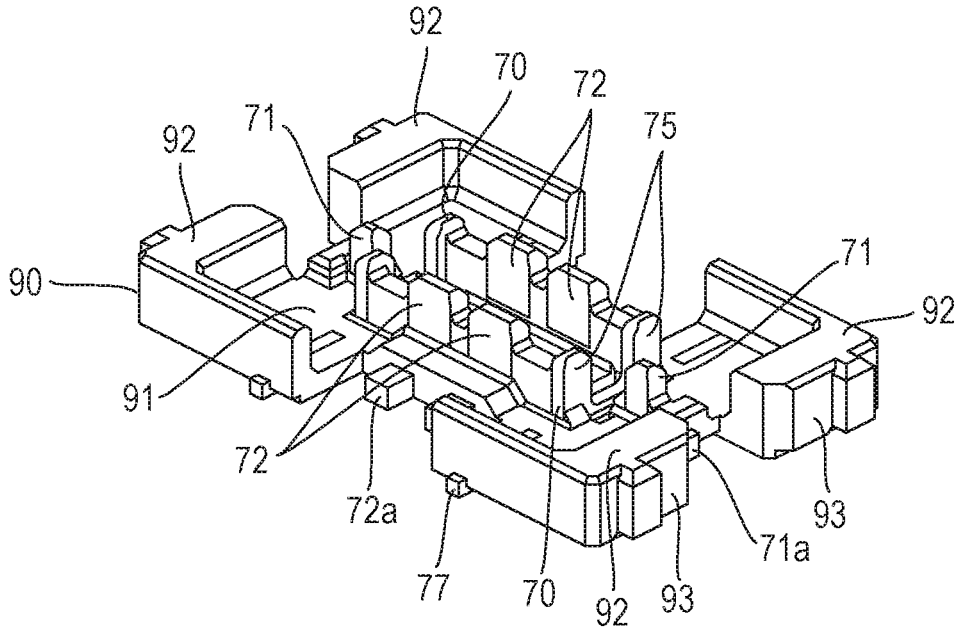
FIG. 10 is a perspective view illustrating a mating insulator and mating terminals held by the mating insulator illustrated in FIG. 7A.

FIGS. 7A, 7B, 8A, and 8B illustrate the mating connector 200. The mating connector 200 is composed of first mating terminals 71, second mating terminals 72, mating ground terminals 70, a mating shell 80, and a mating insulator 90. FIG. 9 illustrates details of the mating shell 80, and FIG. 10 illustrates a state in which the mating shell 80 is detached from the mating connector 200.

The mating insulator 90 is made of resin and includes a bottom plate portion 91 and side walls 92 which are respectively provided on four corner portions of the bottom plate portion 91. The first mating terminals 71 are respectively attached to both longitudinal end portions of the bottom plate portion 91, and two second mating terminals 72 for each of two columns, that is, four second mating terminals 72 in total are attached to the central portion of the bottom plate portion 91. Further, the mating ground terminal 70 is attached between each of the two first mating terminals 71 and the four second mating terminals 72.

The first mating terminal 71 has a columnar shape and includes a connection portion 71*a*, which is to be connected with a board, on the lower end thereof. The second mating terminal 72 has a plate-like shape and includes a connection portion 72*a*, which is to be connected with the board, on the lower end thereof. The two first mating terminals 71 are used for high frequency signals and the four second mating terminals 72 are used for low frequency signals.

Figure 8A:
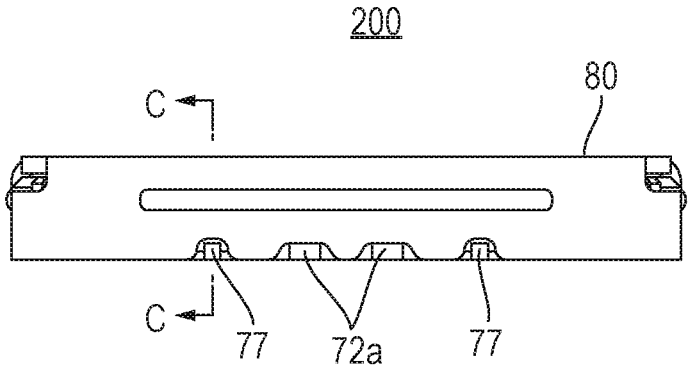
FIG. 8A is a front elevational view illustrating the mating connector illustrated in FIG. 7A.
Figure 8B:
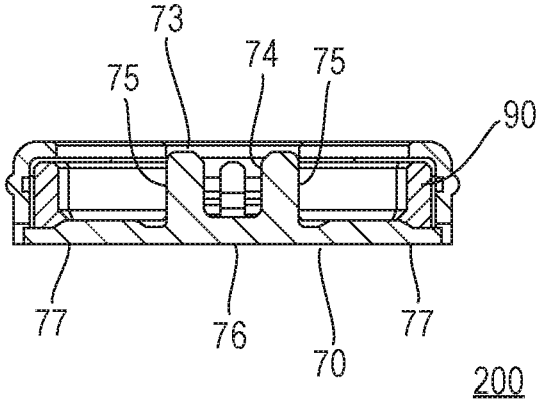
FIG. 8B is a sectional view taken along the C-C line in FIG. 8A.

As illustrated in FIG. 8B, the mating ground terminal 70 includes a mating plate portion 73 on the center in the longitudinal direction. The mating plate portion 73 is shaped to have a pair of projection portions 75 forming a concave portion 74, which opens upward, therebetween. The pair of projection portions 75 protrude from the bottom plate portion 91 of the mating insulator 90. In the mating plate portion 73, a coupling portion 76 coupling the lower ends of the pair of projection portions 75 is positioned and exposed on the bottom surface side of the mating insulator 90. The mating ground terminal 70 is composed of the mating plate portion 73 having the above-described structure and extension portions 77 which are respectively extended from both ends of the coupling portion 76 of the mating plate portion 73. Each of the mating plate portions 73 of the two mating ground terminals 70 is positioned between the first mating terminal 71 and the second mating terminals 72, thus serving as a mating shielding portion.

The mating shell 80 which has a rectangular frame-like shape and has conductivity is formed through bending processing for metal plate. As illustrated in FIG. 9, the mating shell 80 includes outer wall portions 81, outer wall portions 82, and a pair of coupling portions 83. The outer wall portions 81 are respectively positioned on two opposed long sides of the rectangle. The outer wall portions 82 are respectively positioned on two opposed short sides of the rectangle. The coupling portions 83 couple the upper ends of the outer wall portions 81 and the upper ends of the outer wall portions 82 to each other. The pair of coupling portions 83 include plate surfaces that partially close both longitudinal ends of the rectangular frame.

Elongated convex portions 81*a* are respectively formed on the outer surfaces of the pair of outer wall portions 81 in a manner to be extended in the side direction, and elongated convex portions 82*a* are also respectively formed on the outer surfaces of the pair of outer wall portions 82 in a manner to be extended in the side direction. Extension portions 81*b* are formed on both ends in the side direction of the pair of outer wall portions 81 in a manner to be bent and extended toward the outer wall portion 82.

Two cutouts 84 are formed on the lower end of each outer wall portion 81, and cutouts 85 are further formed on both outer sides in the side direction of the two cutouts 84. The cutouts 84 are formed to correspond to the positions of the connection portions 72*a* of the second mating terminals 72. The connection portions 72*a* are exposed on the bottom surface side of the mating insulator 90 in a manner to be held by the mating insulator 90. The cutouts 85 are formed to correspond to the positions of the extension portions 77 of the mating ground terminals 70. The extension portions 77 are exposed on the bottom surface side of the mating insulator 90 in a manner to be held by the mating insulator 90. Protrusions 82*b* are formed in a manner to protrude outward from both ends in the side direction of each outer wall portion 82.

The mating shell 80 having the above-described structure is attached to the mating insulator 90 that holds the first mating terminals 71, the second mating terminals 72, and the mating ground terminals 70. The attachment of the mating shell 80 is performed by putting the mating shell 80 over the mating insulator 90 and forcing the mating shell 80 into the mating insulator 90. Each of the outer wall portions 82 including the protrusions 82*b* is pressed into a concave portion 93 which is formed on the outer sides of side walls 92 of the mating insulator 90 in a manner to straddle two side walls 92. As a result, the mating connector 200 illustrated in FIGS. 7A, 7B, 8A, and 8B is completed.

The above-described connector 100 and mating connector 200 constitute a board-to-board connector in which the connector 100 and the mating connector 200 are respectively mounted on opposing surfaces of boards, which are opposed to each other, and fitted and connected to each other. In the connector 100, the connection portions 41*b* and 42*b* of the first terminals 41 and second terminals 42, portions, which are exposed on the bottom surface of the insulator 60, of the plate portions 44 of the ground terminals 40 (intermediate portions of the U shape of the pair of U-shaped portions 43), and the shell 50 are soldered and connected to corresponding pad or pattern of the boards.

On the other hand, in the mating connector 200, the connection portions 71*a* and 72*a* of the first mating terminals 71 and second mating terminals 72, the coupling portions 76 of the mating plate portion 73 and the extension portions 77 of the mating ground terminals 70, and further, the mating shell 80 are soldered and connected to corresponding pad or pattern of the boards.

FIGS. 11A, 11B, 11C, and 11D illustrate a connector assembly according to the present invention in which the connector 100 and the mating connector 200 are fitted to each other, and the drawings omit illustration of boards.

Through the fitting of the mating connector 200 to the connector 100, the first terminals 41 and the second terminals 42 are respectively fitted and connected to the first mating terminals 71 and the second mating terminals 72. Further, the convex portions 81*a* and 82*a* formed on the mating shell 80 ride over and fit in the curved portions 51*a* and 52*a* of the shell 50 respectively and thus, the mating shell 80 is fitted in the inside of the shell 50.

Figure 11A:
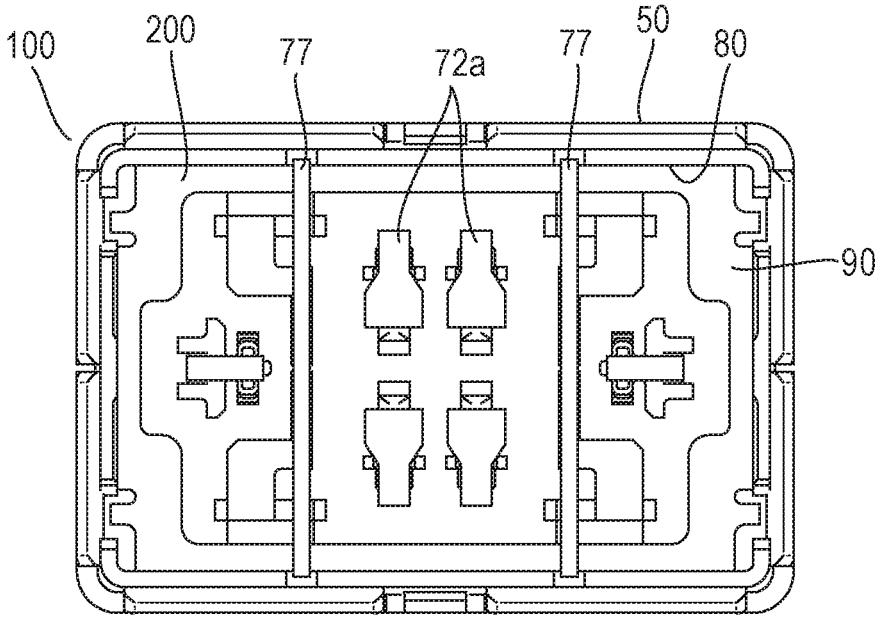
FIG. 11A is a plan view illustrating the connector assembly according to the first embodiment of the present invention.
Figure 11B:
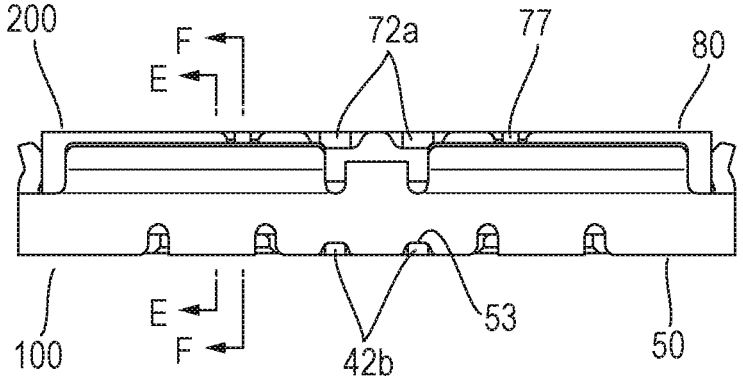
FIG. 11B is a front elevational view illustrating the connector assembly according to the first embodiment of the present invention.
Figure 11C:
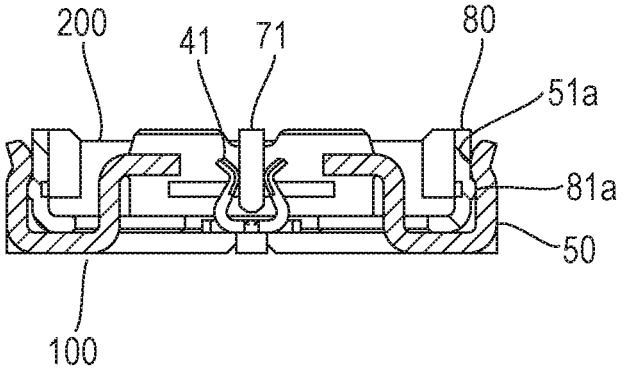
FIG. 11C is a sectional view taken along the E-E line in FIG. 11B.
Figure 11D:
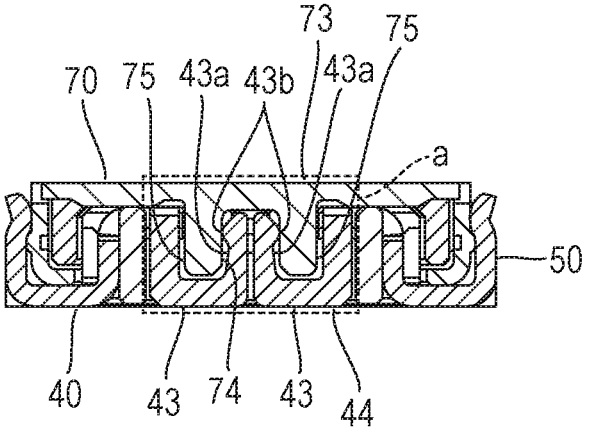
FIG. 11D is a sectional view taken along the F-F line in FIG. 11B.

On the other hand, the plate portion 44 of the ground terminal 40 and the mating plate portion 73 of the mating ground terminal 70 have plate surfaces that are parallel to each other and are parallel to the fitting direction of the connector 100 and the mating connector 200. As illustrated in FIG. 11D, the pair of projection portions 75 of the mating plate portion 73 is positioned so that the projection portions 75 are respectively inserted into U shapes of the pair of U-shaped portions 43 in the plate portion 44. Further, both of the leg portions 43*a* of mutually-adjacent U shapes in the pair of U-shaped portions 43 are inserted and positioned in the concave portion 74 of the mating plate portion 73. The leg portions 43*a* of mutually-adjacent U shapes elastically deform toward the mutually-approaching direction when inserted into the concave portion 74, and the protrusion portions 43*b*, which are formed on the end sides of the leg portions 43*a*, are respectively brought into elastic contact with the inner surfaces of the pair of projection portions 75 by elastic restoring force of the leg portions 43*a*. Accordingly, the plate portion 44, which serves as the shielding portion between the first terminal 41 and the second terminals 42, and the mating plate portion 73, which serves as the mating shielding portion between the first mating terminal 71 and the second mating terminals 72, are mutually conducted.

The plate portion 44 and the mating plate portion 73 are thus combined with each other to constitute a shield between a couple of the first terminal 41 and first mating terminal 71 for high frequency signals and a couple of the second terminals 42 and the second mating terminals 72 for low frequency signals, in this example. Part a surrounded by a dotted line in FIG. 11D represents the part in which the shield is constituted, and this shield blocks electromagnetic interference between terminals (between terminals for high frequency signals and terminals for low frequency signals, and between terminals for both high frequency signals).

The plate portion 44 and the mating plate portion 73 mutually have the same thickness (plate thickness) in this example, and the range of the thickness position of the plate portion 44 is accorded with the range of the thickness position of the mating plate portion 73. That is, the plate portion 44 and the mating plate portion 73 are combined with each other as they form one plate. A gap between the plate portion 44 and the mating plate portion 73 and a gap between the leg portions 43*a*, which are inserted and positioned in the concave portion 74 of the mating plate portion 73, of adjacent U shapes of the plate portions 44 are set to be smaller than the thicknesses of the plate portion 44 and the mating plate portion 73. Accordingly, favorable shielding performance is secured in this example.

It is to be noted that the thickness of the plate portion 44 and the thickness of the mating plate portion 73 do not have to be always the same as each other. When having the mutually different thicknesses, the plate portion 44 and the mating plate portion 73 are combined with each other so that the range of the thickness position of one of the plate portion 44 and the mating plate portion 73 is within the range of the thickness position of the other. Thus, if the thickness of the plate portion 44 and the thickness of the mating plate portion 73 are different from each other, the gap between the plate portion 44 and the mating plate portion 73 and the gap between the leg portions 43*a*, positioned in the concave portion 74, of the U shapes are set smaller than the thickness of the plate portion 44 or the mating plate portion 73 which has the smaller thickness.

Second Embodiment

In the above-described first embodiment, the shielding portion of the ground terminal 40 positioned between the first terminal 41 and the second terminals 42 of the connector 100 is the plate portion 44 composed of a pair of U-shaped portions 43, and the mating shielding portion of the mating ground terminal 70 positioned between the first mating terminal 71 and the second mating terminals 72 of the mating connector 200 is the mating plate portion 73 having the shape including a pair of projection portions 75 which form the concave portion 74 therebetween. However, these shielding portions may employ another structure.

Figure 12A:
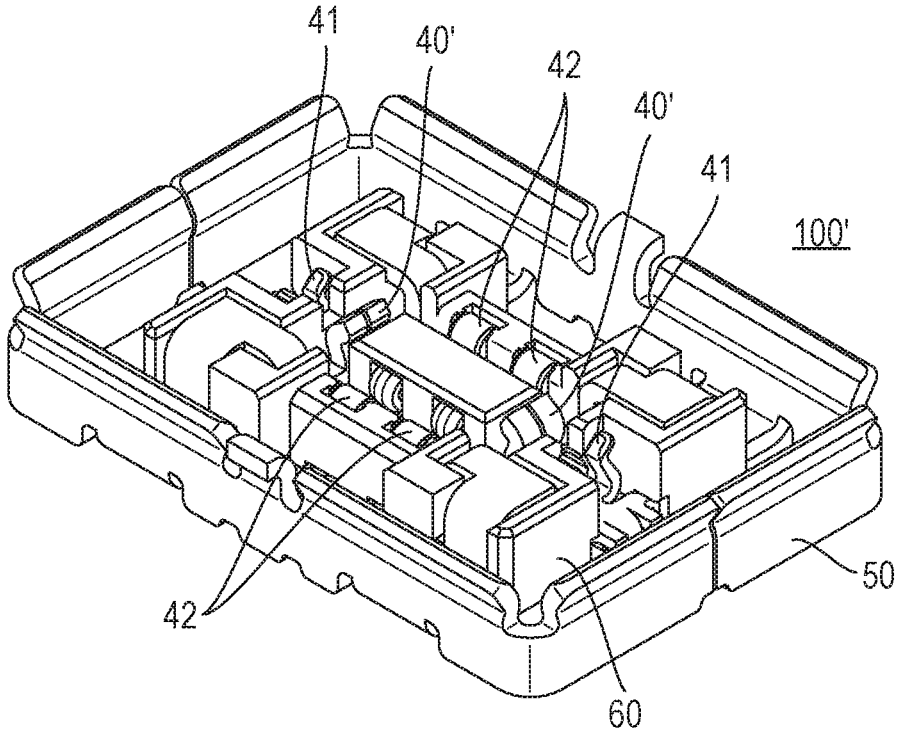
FIG. 12A is an upper perspective view illustrating one connector constituting a connector assembly according to a second embodiment of the present invention.
Figure 12B:
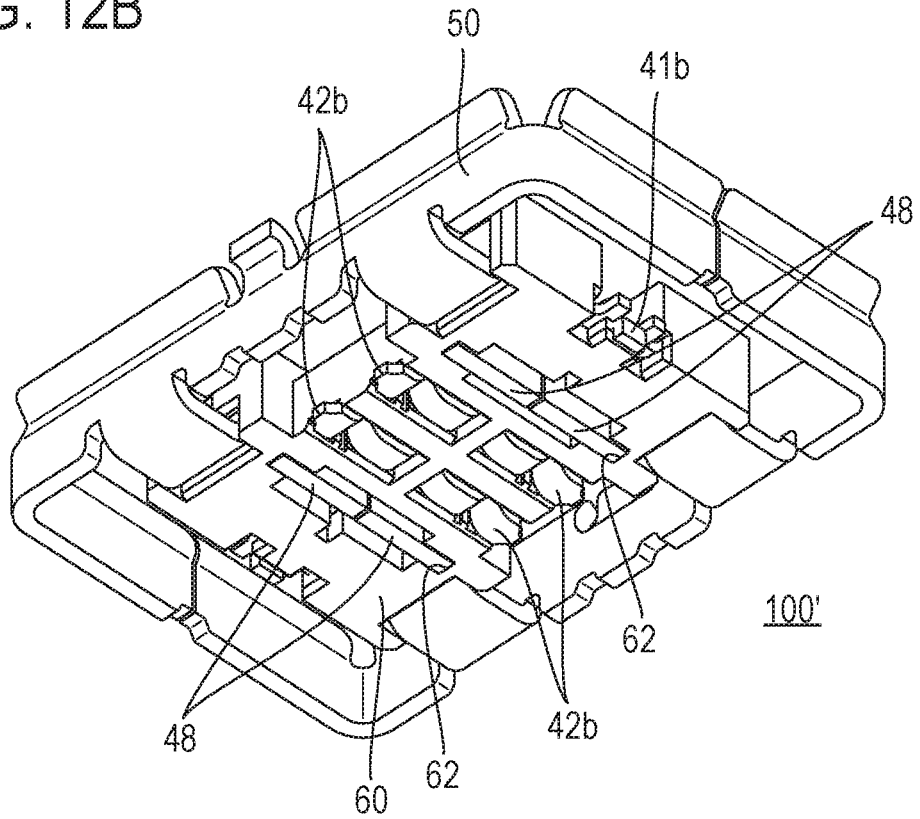
FIG. 12B is a lower perspective view illustrating the connector illustrated in FIG. 12A.
Figure 13:
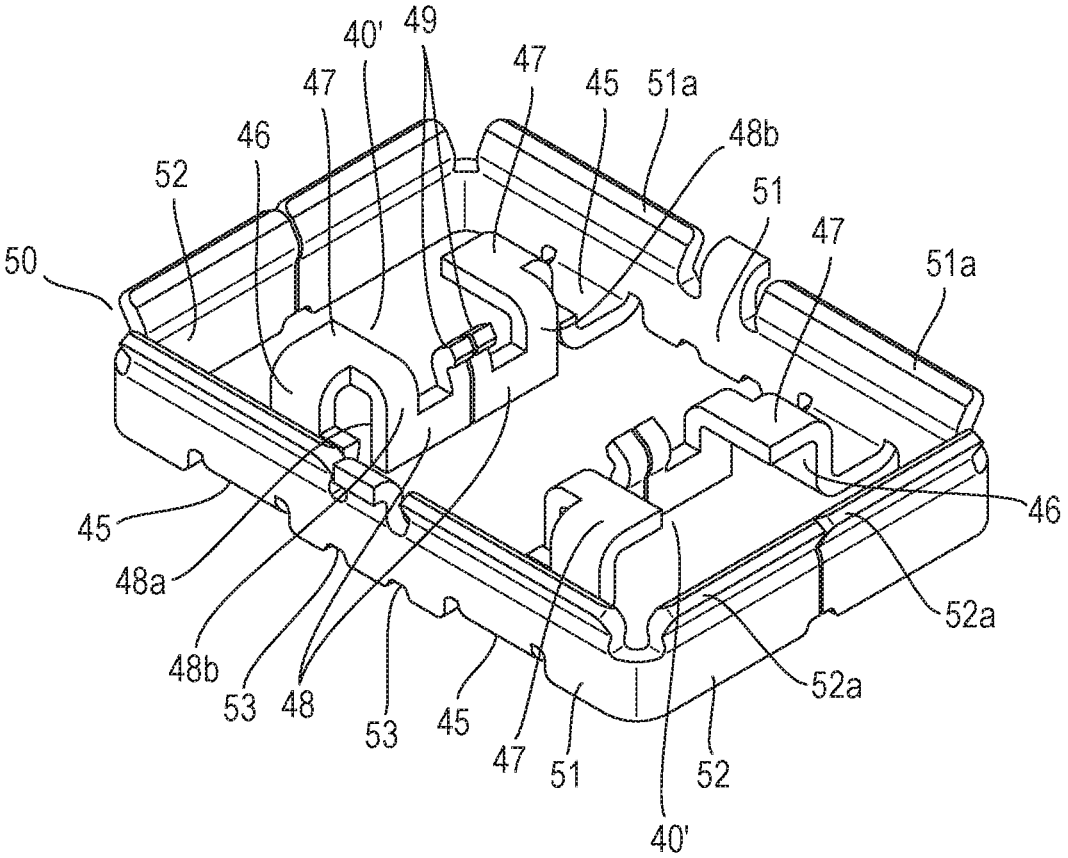
FIG. 13 is a perspective view illustrating ground terminals integrated with a shell illustrated in FIG. 12A.
Figure 14A:
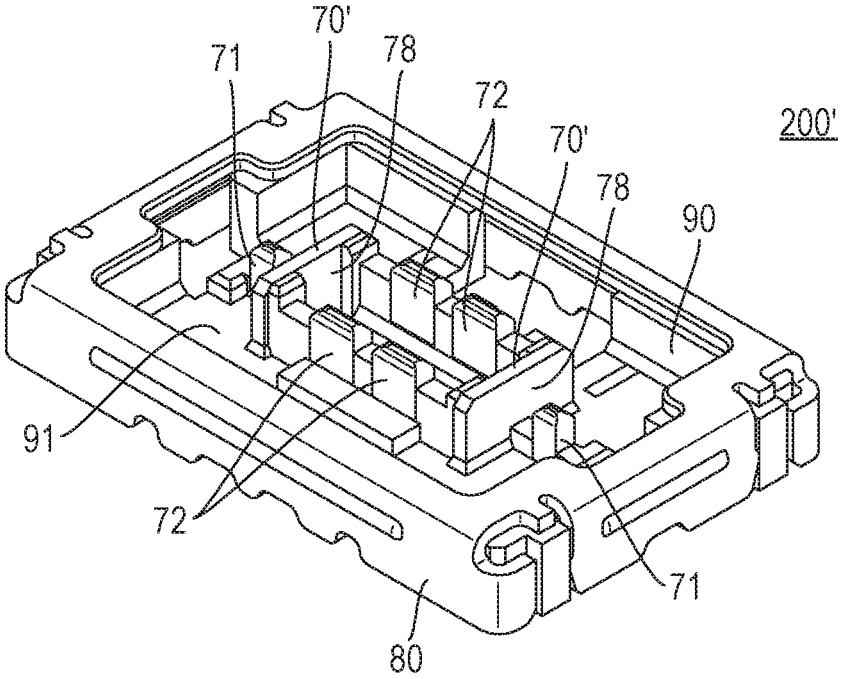
FIG. 14A is an upper perspective view illustrating a mating connector constituting the connector assembly according to the second embodiment of the present invention.
Figure 14B:
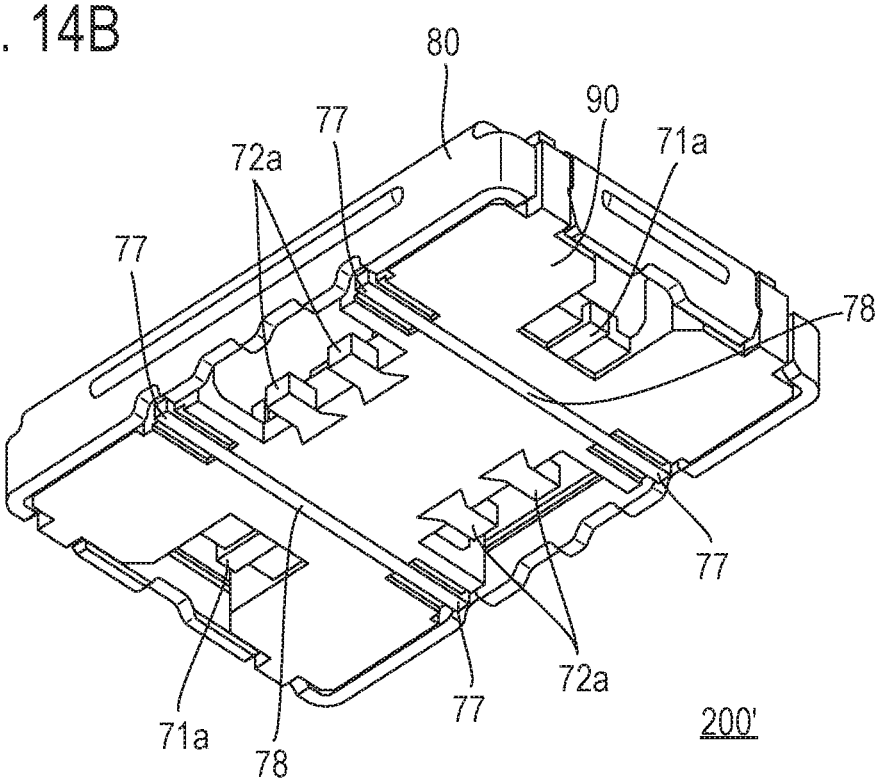
FIG. 14B is a lower perspective view illustrating the mating connector illustrated in FIG. 14A.

A second embodiment describes another structure of shielding portions included in a ground terminal and a mating ground terminal in a connector and a mating connector. FIGS. 12A and 12B illustrate a connector 100' according to the second embodiment, and FIG. 13 illustrates ground terminals 40' integrated with a shell 50 in the connector 100'. Further, FIGS. 14A, 14B, 15A, and 15B illustrate a mating connector 200', and FIGS. 16A and 16B illustrate a state in which the connector 100' and the mating connector 200' are fitted to each other. In FIGS. 12A, 12B, 13, 14A, 14B, 15A, 15B, 16A, and 16B, components corresponding to the structure of the first embodiment illustrated in FIGS. 3A, 3B, 4A, 4B, 5, 6, 7A, 7B, 8A, 8B, 9, 10, 11A, 11B, 11C, and 11D will be provided with the same reference characters, and detailed description thereof will be omitted.

Figure 15A:
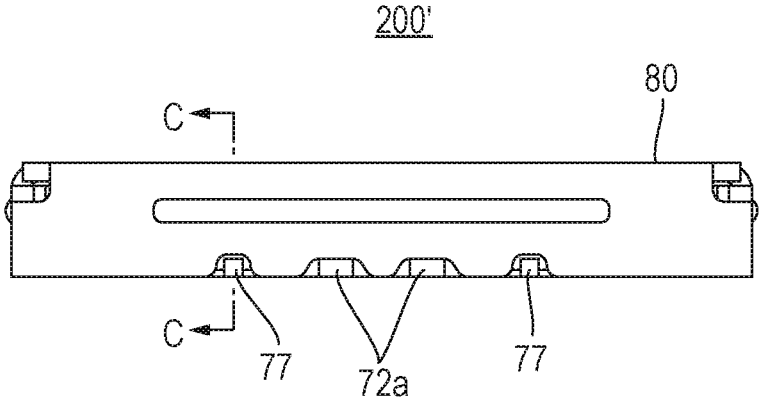
FIG. 15A is a front elevational view illustrating the mating connector illustrated in FIG. 14A.
Figure 15B:
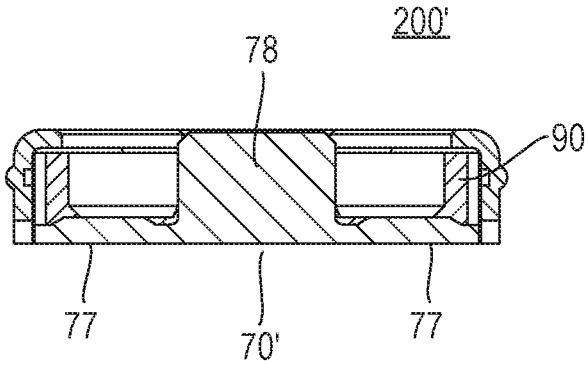
FIG. 15B is a sectional view taken along the C-C line in FIG. 15A.
Figure 16A:
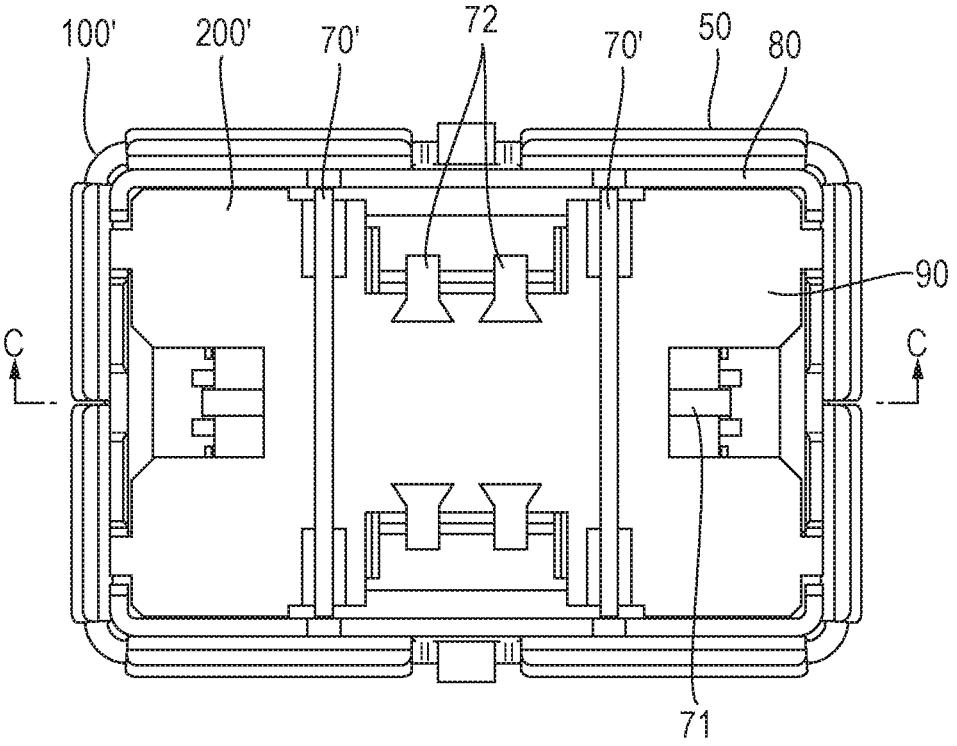
FIG. 16A is a plan view illustrating the connector assembly according to the second embodiment of the present invention.
Figure 16B:
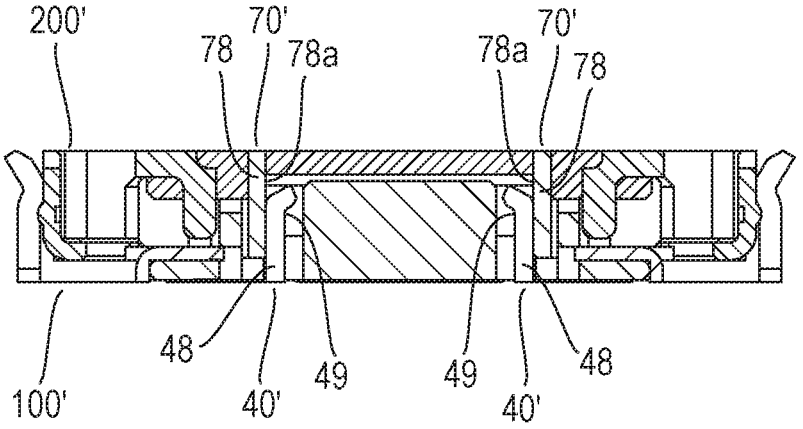
FIG. 16B is a sectional view taken along the C-C line in FIG. 16A.

As illustrated in FIG. 15B, a mating shielding portion included in a mating ground terminal 70' is composed of a flat plate portion 78 having a substantially rectangular shape, and the mating ground terminal 70' is composed of the flat plate portion 78 and extension portions 77 which are extended from both ends of a lower side of the flat plate portion 78, in this example. The flat plate portion 78 protrudes on a bottom plate portion 91 of a mating insulator 90 and are positioned between a first mating terminal 71 and second mating terminals 72, and the lower side of the flat plate portion 78 and the extension portions 77 are positioned and exposed on the bottom surface side of the mating insulator 90.

On the other hand, a shielding portion included in the ground terminal 40' is composed of a pair of U-shaped portions 48 which are adjacent to each other, as illustrated in FIG. 13. Leg portions of the mutually-adjacent U shapes in the pair of U-shaped portions 48 are contact portions 49 that are elastically displaced in a contact direction which is orthogonal to plate surfaces 48*a* of the U-shaped portions 48. The contact portion 49 has a shape bent in an L shape. As is the case with the ground terminal 40 in the first embodiment, the ground terminal 40' includes coupling portions 45, held portions 46, and extension portions 47, and leg portions 48*b* positioned on the mutual outer sides of the pair of U-shaped portions 48 are formed as being extended from the extension portions 47 respectively.

Each pair of U-shaped portions 48 of two ground terminals 40' is inserted into a slit 62 of an insulator 60 and positioned between a first terminal 41 and second terminals 42.

As illustrated in FIG. 16B, in the connector assembly in which the connector 100' and the mating connector 200' are fitted and connected to each other, the contact portion 49 comes into elastic contact with a plate surface 78*a* of the flat plate portion 78 in this example, where the flat plate portion 78 has the plate surface (mating plate surface) which is parallel to the fitting direction, the contact direction between the contact portion 49 and the flat plate portion 78 is orthogonal to the plate surface 78*a*, and the contact portion 49 is elastically displaceable in the contact direction which is orthogonal to the fitting direction. Accordingly, the pair of U-shaped portions 48 serving as the shielding portion of the ground terminal 40' and the flat plate portion 78 serving as the mating shielding portion of the mating ground terminal 70' are conducted and combined with each other, structuring a shield for blocking electromagnetic interference between a couple of the first terminal 41 and the first mating terminal 71 and a couple of the second terminals 42 and the second mating terminals 72, as is the case with the first embodiment.

The foregoing description of the embodiments of the invention has been presented for the purpose of illustration and description. It is not intended to be exhaustive and to limit the invention to the precise form disclosed. Modifications or variations are possible in light of the above teaching. The embodiment was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A connector assembly in which a connector that includes a first terminal, a second terminal, a ground terminal, the ground terminal including a shielding portion positioned between the first terminal and the second terminal, and a shell, the shell having conductivity and a frame-like shape, and a mating connector that includes a first mating terminal, a second mating terminal, a mating ground terminal, and a mating shell are fitted to each other, the first mating terminal and the second mating terminal being connected with the first terminal and the second terminal respectively, the mating ground terminal including a mating shielding portion positioned between the first mating terminal and the second mating terminal, the mating shell having conductivity and a frame-like shape, wherein the ground terminal and the shell are integrally formed through bending processing for metal plate, the ground terminal and the mating ground terminal are connected with each other through elastic contact between the shielding portion and the mating shielding portion, the shielding portion is composed of a plate portion having a plate surface that is parallel to a fitting direction between the connector and the mating connector, the mating shielding portion is composed of a mating plate portion having a mating plate surface that is parallel to the fitting direction, the plate portion is composed of a pair of U-shaped portions that are adjacent to each other, the mating plate portion is shaped to have a pair of projection portions forming a concave portion therebetween, the plate surface and the mating plate surface are parallel to each other, and a range within which a thickness of one of the plate portion and the mating plate portion is located is within a range within which a thickness of the other is located, the projection portions formed in the pair are respectively inserted and positioned in U shapes of the pair of U-shaped portions, each of leg portions of mutually-adjacent U shapes in the pair of U-shaped portions is inserted and positioned in the concave portion, and protrusion portions that are formed on end sides of the leg portions of the mutually-adjacent U shapes in a manner to protrude mutually outward are respectively in elastic contact with the projection portions formed in the pair.

* * * * *